US006193529B1

(12) United States Patent
Kimura

(10) Patent No.: US 6,193,529 B1
(45) Date of Patent: Feb. 27, 2001

(54) CONNECTOR TERMINAL PROTECTIVE COVER

(75) Inventor: Takao Kimura, Tsujido-Motomachi (JP)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/284,129

(22) PCT Filed: Oct. 24, 1997

(86) PCT No.: PCT/US97/19215

§ 371 Date: Apr. 8, 1999

§ 102(e) Date: Apr. 8, 1999

(87) PCT Pub. No.: WO98/19370

PCT Pub. Date: May 7, 1998

(30) Foreign Application Priority Data

Oct. 25, 1996 (JP) ..... 8-301141

(51) Int. Cl.[7] ..... H01R 13/44
(52) U.S. Cl. ..... 439/149
(58) Field of Search ..... 439/149, 135, 439/148, 367, 910, 150, 892, 893, 521, 51

(56) References Cited

U.S. PATENT DOCUMENTS

| | | | | |
|---|---|---|---|---|
| 4,914,265 | * | 4/1990 | Mongneau | 439/149 |
| 5,026,295 | * | 6/1991 | Fong et al. | 439/149 |
| 5,161,996 | | 11/1992 | Locati | 439/374 |

FOREIGN PATENT DOCUMENTS

| | | | |
|---|---|---|---|
| 0 036 770 A2 | 9/1981 | (EP) | H01R/13/645 |
| 0 747 998 A2 | 12/1996 | (EP) | H01R/9/09 |

* cited by examiner

*Primary Examiner*—Brian Sircus
*Assistant Examiner*—J. F. Duverne

(57) ABSTRACT

A connector terminal protective cover which can be attached directly to an end portion of a connector housing, and which also has a simple structure and is inexpensive. The connector terminal protective cover (1) is attached to a connector housing by causing projections (12,12') on arms (4,4') located on both sides of the cover (1) to engage with the side walls (118, 118') of the connector (100). The end portion (110) of the connector (100) is open, and the cover (1) has a covering section (2) that covers the opening (112) in the end portion (110). The cover (1) can be removed by bending the arms (4,4') outwardly so that the engagement with the side walls is released.

5 Claims, 3 Drawing Sheets

CONNECTOR TERMINAL PROTECTIVE COVER

FIELD OF THE INVENTION

The present invention relates to a connector terminal protective cover that is attached to an end portion of a connector.

BACKGROUND OF THE INVENTION

Header connectors of the type shown in FIGS. 6 through 8 are known as connectors that are mounted on printed circuit boards. FIG. 6 is a front view of a header connector 100. This header connector 100 has a plastic housing 102 that is substantially U-shaped in cross-section, with the tine sections 108 of terminals 106 protruding from the bottom surface 104. Until a plug connector (not shown) is inserted into the connector 100, the contact sections 106*a* of the terminals 106 (see FIG. 7) are exposed, and are therefore susceptible to deformation by external forces. Accordingly, a connector 150 which covers the opening 112 (see FIG. 7) in the end portion 110 of the housing 102 is disposed on the right end of the housing 102 (with respect to FIG. 6). Connector 150 has terminals 152 with tine sections 158 which protrude from the bottom surface 154 of the connector 150. The tine sections 108 and 158 have compliant portions that possess springiness and that engage with through-holes in a circuit board 200. The tine sections 108 and 158 are fastened to the circuit board 200 by press-fitting, so that the connectors 100 and 150 are fastened to the circuit board 200. As a result, the opening 112 in the end portion 110 of the connector 100 is covered by the housing 156 of the connector 150, so that the terminals 106 are protected from external forces, and from invasion by outside dust.

FIG. 7 is an end view of the connector 100 alone, as seen from the direction indicated by arrow A in FIG. 6. It is seen from this end view that the housing 102 is open at the top and at both ends, i.e., in the direction perpendicular to the plane of the page. A plug housing is inserted into the recessed portion 116 of housing 102, and the respective terminals are electrically connected to each other.

When the connector 100 is in an unattached state prior to being attached to the circuit board 200, there is a considerable possibility that the contact sections 106*a* of the terminals 106 will be subjected to external forces or contamination by dust, etc. However, in the case of a conventional system, deformation or contamination of the contact sections 106*a* cannot be prevented.

The connector 150 can be electrically connected with a plug connector; however, there are cases in which this is not necessary, and the use of such a connector 150 results in an increase in the number of parts.

Furthermore, as is shown by another similar conventional example illustrated in FIG. 8, a so-called "mid-plane" mounting configuration may be adopted in which the tine sections 108' of the terminals 106' of a connector 100' pass through a circuit board 200 and protrude a considerable distance beyond circuit board 200, and a shroud 130 is fit over protruding tine sections 108' and fastened in place from the opposite side of the circuit board 200. In this case, however, connectors 150 used as covers cannot be installed in the same positions on the end portions of the connector 100' and shroud 130. The reason for this is that the through-holes of the circuit board 200 into which the connectors 150 are inserted cannot be used in common by both connectors 150, and in cases where these through-holes are not used in common, the spacing of the through-holes is excessively small so that strength cannot be maintained.

SUMMARY OF THE INVENTION

In light of the above points, a feature of the present invention is to provide a connector terminal protective cover that is attached in a freely detachable manner to an end portion of a housing, and that constantly protects the terminals even prior to the attachment of the connector to a circuit board.

Another feature of the present invention is to provide a connector terminal protective cover which has a simple structure, and which is inexpensive.

Still another feature of the present invention is to provide a connector terminal protective cover that can also be used in mid-plane mounting situations.

The connector terminal protective cover of the present invention is attached in a detachable manner to the open end portion of a connector having a housing that is substantially U-shaped in cross section, and has a covering surface that covers the end portion.

A connector terminal protective cover for latchable engagement to a connector housing of a connector comprises a cover section, arms extending outwardly from edges of the cover section and being substantially normal thereto. The protective cover is latchable to an open end portion of the connector housing (102) such that the cover section extends along the open end portion and the arms extend along side walls of the housing. The arms include latching members for engaging grooves on the housing to latch the protective cover onto the housing to prevent the attached cover from being laterally removed from the housing. The arms further include projections for engaging recessed grooves on the housing to prevent the attached cover from being moved upwardly.

BRIEF DESCRIPTION OF THE DRAWINGS

An embodiment of the present invention will now be described by way of example with reference to the accompanying drawings in which.

DETAILED DESCRIPTION

Figure 1:
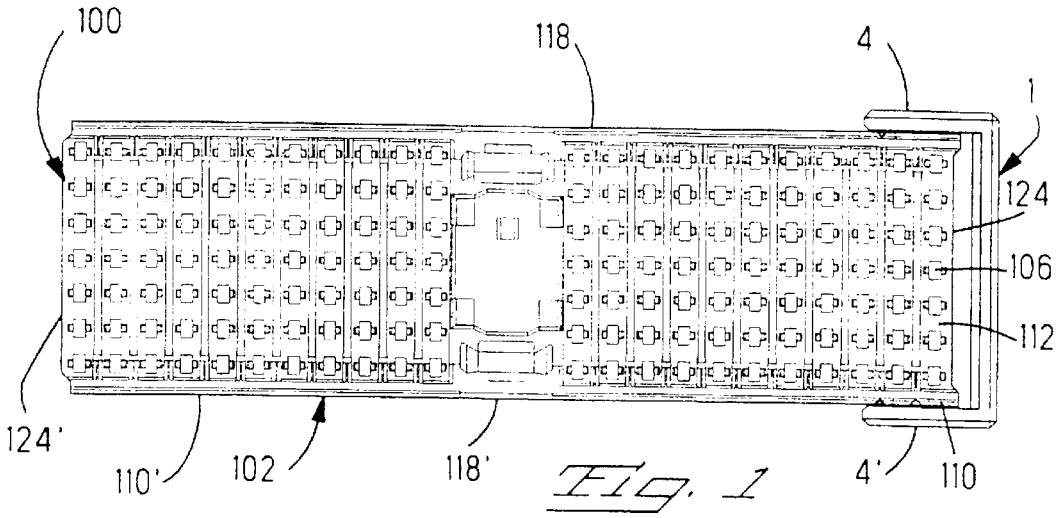
FIG. 1 is a top plan view that shows a terminal protective cover of the present invention attached to an end portion of a connector.
Figure 6:
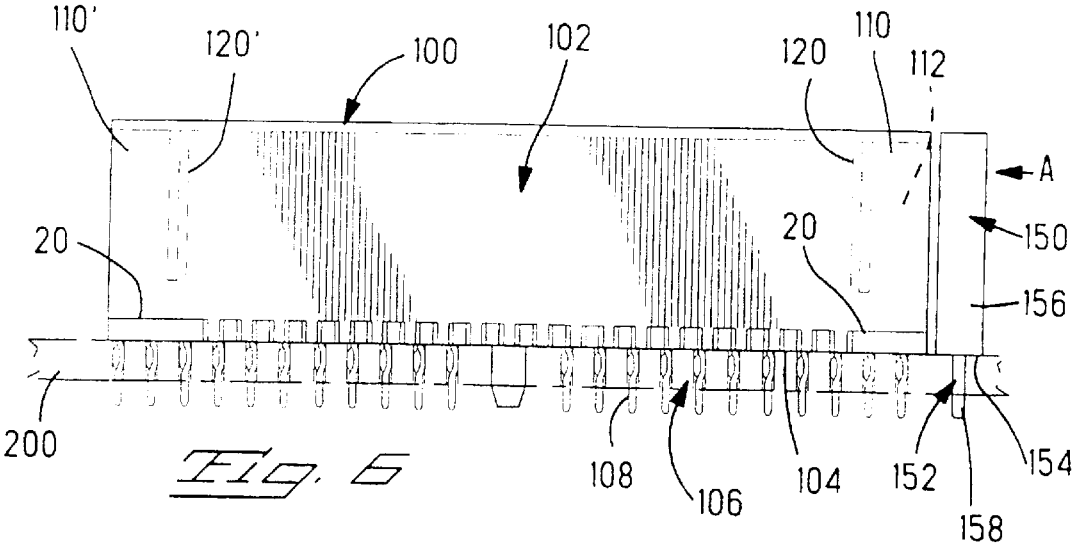
FIG. 6 is a front view of a conventional connector.

FIG. 1 shows a connector terminal protective cover 1 of the present invention, hereafter referred to simply as a protective cover, mounted on an end portion 110 of a connector 100. The cover 1 is substantially U-shaped, and has arms 4, 4' on both sides of a main section, i. e., covering section 2. Projections 12, 12' (see FIG. 2) are formed on the arms 4, 4', and projections 12, 12' engage with engaging grooves 120, formed in the side walls 118, 118' of the housing 102 (FIGS. 1, 6), so that the cover 1 is latchably attached to the connector 100. The engaging grooves 120, 120' are formed as long grooves extending downward from the upper ends of walls 118, 118' (as shown by the broken lines in FIG. 6) in both end portions 110, 110' of the housing 102. As shown, cover 1 is ordinarily mounted on one end portion 110 of the housing 102; however, another cover 1 is similarly mounted on the other end portion 110'. Each cover 1 can be latchable to either the right or left end portion 110, 110' of the housing 102.

The ends 124, 124' of the housing 102 are formed with complementary shapes. Specifically, the end 124 is formed with a slightly recessed shape, and the end 124' is formed with a shape that protrudes by an amount corresponding to the recess in the end 124. Accordingly, housings 102 can be continuously installed on the circuit board 200 in tight engagement in the direction of length by removing the covers 1. In this case, it is necessary to remove only the covers 1 located on the ends where adjacent housings 102 engage each other. Thus, the covers 1 on the outermost end portions 110 of the continuously linked connectors 100 are left "as is" on the housings 102. The engaging grooves 120, 120' are formed in positions located at equal distances from the ends 124, 124'.

Figure 2:
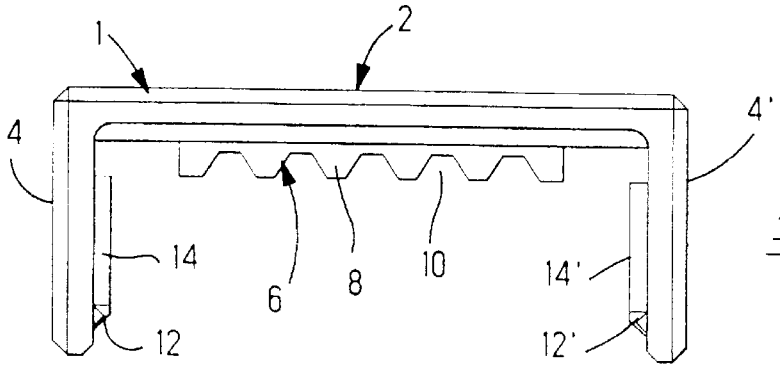
FIG. 2 is a top plan view of the terminal protective cover of the present invention.

Next, the shape of the protective cover 1 will be described in detail with reference to FIGS. 2 through 5. FIG. 2 shows a top plan view of the cover 1. A projecting member 6 is formed on the bottom portion of the covering section 2 of the cover 1. Projecting member 6 protrudes downwardly and forwardly in FIGS. 2 and 3, so that a front surface end 8 of the projecting member 6 engages the end 124 or 124' when the cover 1 is attached to the housing 102. Spaced recesses 10, which are recessed inward from the front surface 8, are formed in the projecting member 6. Recesses 10 are provided as relief areas to receive outermost terminals 106 so that there is no interference with the outermost row of terminals 106 when the cover is attached to the housing 102 from above, i. e., from the direction of the foreground in FIG. 1. Respective projections 12, 12' are formed on the inside surfaces of the front ends, i. e., the free ends, of the arms 4, 4'. Projections 12, 12' engage with the engaging grooves 120, 120' of the housing 102 so that the cover 1 is latchably attached to the connector 100. Thus, projections 12, 12' operate as latching members. Furthermore, projections 14, 14', which extend inwardly from the vicinity of the free ends of the arms 4, 4', are formed on the arms 4, 4'. The function of projections 14, 14' will be described later.

Figure 3:
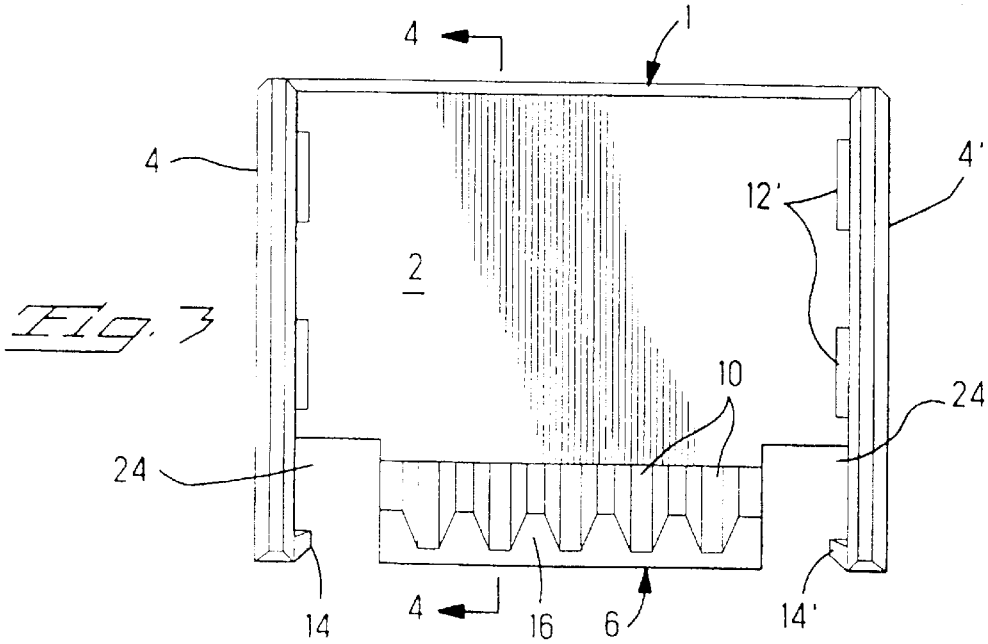
FIG. 3 is front view of the cover shown in FIG. 2.

FIG. 3 shows a front view of the cover 1. By means of cut-outs 24, 24', the projecting member 6 is formed into a shape that protrudes downward from the substantially rectangular covering section 2. Since both ends of the projecting member 6 are separated from the arms 4, 4', the projecting member 6 is flexible in the direction perpendicular to the plane of the page. A beveled surface 16 is formed in the lower portion of the projecting member 6 so that the projecting member 6 does not get caught on the end 124 or 124' when the cover 1 is attached to the housing 102 from above. The projections 12 and 12' respectively consist of two projections that are separated from each other in the vertical direction on each of the arms 4 and 4'. The projections 14 and 14' are formed at the lower ends of the arms 4 and 4' and extend perpendicular to projections 12, 12'. The arms 4 and 4' can bend slightly outward when the cover 1 is attached to the housing 102. In particular, the lower portions of the arms 4 and 4' can be flexed to a considerable extent.

Figure 4:
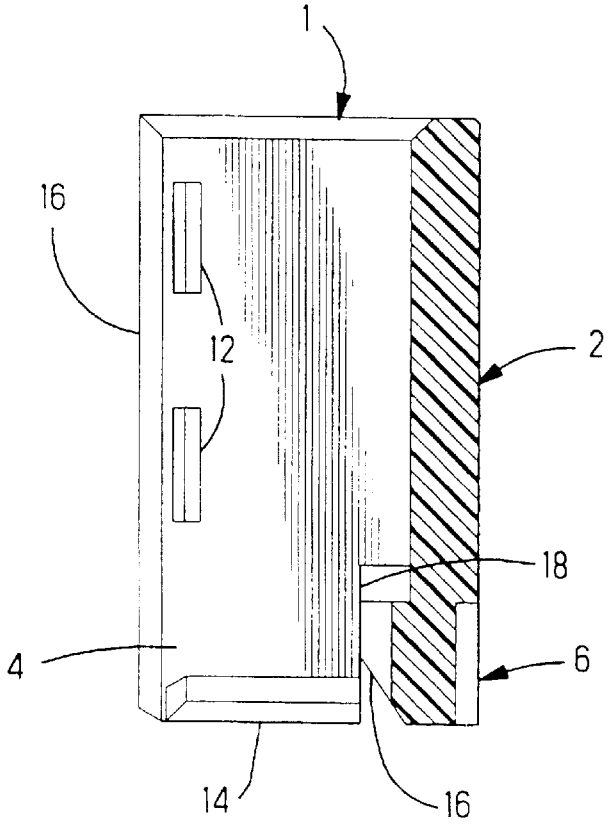
FIG. 4 is a cross-sectional view of the cover shown in FIG. 3 taken along lone 4—4 in FIG. 3.
Figure 7:
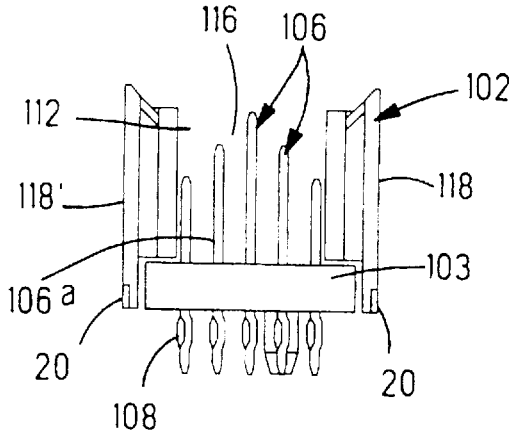
FIG. 7 is an end view of the connector shown in FIG. 6.
Figure 8:
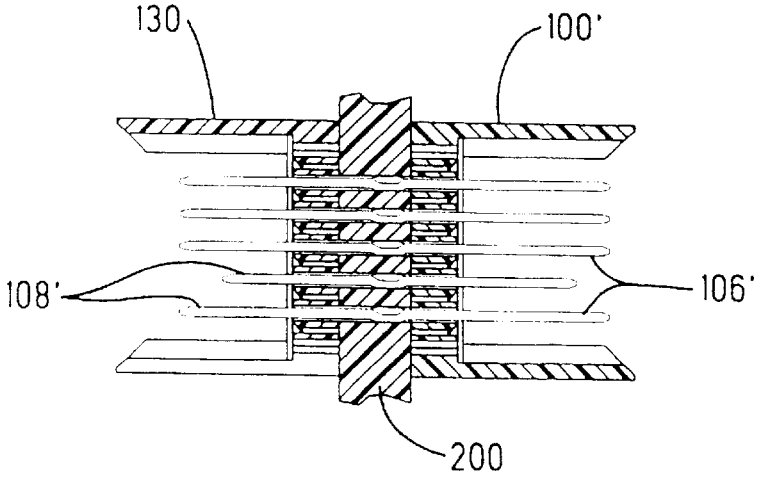
FIG. 8 is a cross-sectional view that shows another similar conventional connector attached to a circuit board.

Next, FIG. 4 shows a cross-sectional view along line 4—4 in FIG. 3. Here, the vertical arrangement of the projections 12, 12 is clearly shown. The projection 14 is formed on the lower end of the arm 4 so that projection 14 extends to the rear end 18 of the arm 4 from the front end thereof. When the cover 1 is attached to the connector 100, the projections 14 and 14' engage with recessed grooves 20 (see FIGS. 6 and 7) formed in the end portion 110 of the bottom surface 104 of the housing 102, so that the cover 1 is prevented from slipping upward. The cover 1 may be attached to or removed from the connector 100 from above, or from the side, i. e., from the side of the end portion 110. Projections 12, 12'–14, 14' have leading beveled surfaces to enable arms 4, 4' to flex when cover 1 is attached to housing 102.

Figure 5:
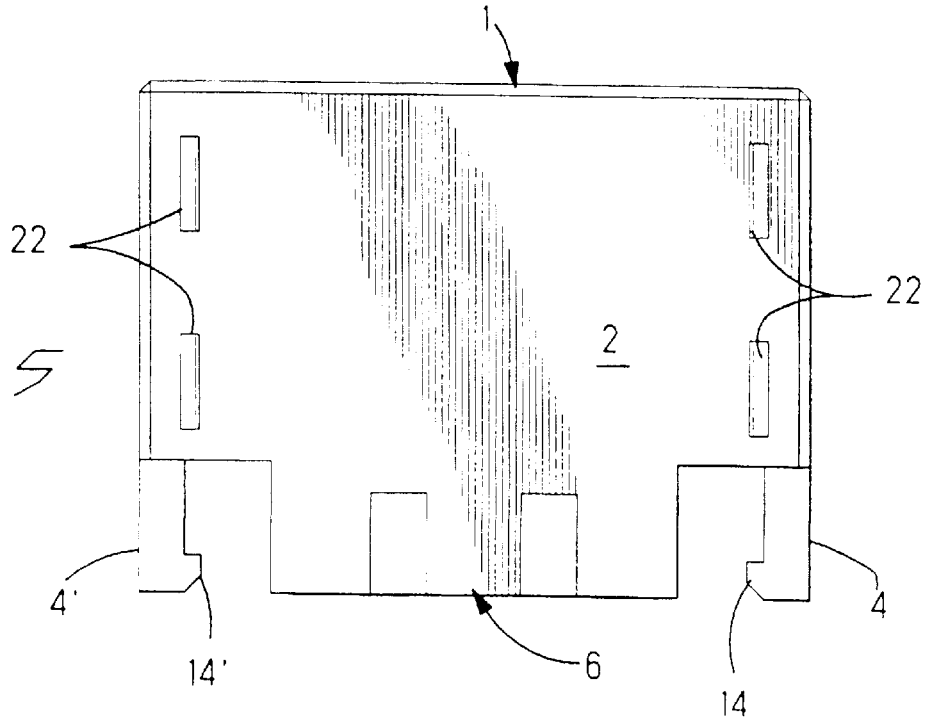
FIG. 5 is a rear view of the cover shown in FIG. 3.

FIG. 5 shows a back view of the cover 1. In FIG. 5, mold slots 22 are shown in cover section 2, which are used to form the projections 12.

The protective cover of the present invention has been described in detail above. However, the present invention is not limited to the above working configuration; it goes without saying that various modifications and alterations are possible. For example, the cover could also be applied to surface-mounted connectors.

The connector terminal protective cover of the present invention is attached to an open end portion of a connector having a housing that is substantially U-shaped in cross section, and has a covering section that covers the end portion. Accordingly, the connector terminal protective cover of the present invention possesses the following advantages:

Specifically, since the protective cover of the present invention is attached directly to an end portion located on the side of the housing, there is no deformation of the terminals by external forces during handling of the housing. Furthermore, the connector can be mounted "as is" on a circuit board. Accordingly, handling is easy, and since the structure is simple, the protective cover of the present invention is inexpensive.

Furthermore, the protective cover of the present invention can also be applied to so-called mid-plane mounting, in which connectors that receive plug connectors are installed on both sides of a circuit board.

What is claimed is:

1. A connector terminal protective cover (1) for latchable engagement to a connector housing (102) having a pair of opposite side walls (118, 118') and an open end portion (110), the protective cover comprising:

a cover section (2), arms (4, 4') extending outwardly from edges of the cover section (2) in a direction normal to the cover section, the protective cover (1) being latchable to the connector housing (102) such that the cover section (2) extends along the open end portion (110) and the arms (4, 4') extend along the side walls (118, 118') of the housing (102);

the arms (4, 4') including latching members (12, 12') for engaging grooves (120, 120') in the side walls (118, 118') to latch the protective cover (1) onto the housing (102) to prevent the attached cover (1) from being laterally removed from the housing; and the arms (4, 4') further including projections (14, 14') separate from the latching members (12, 12') for engaging recessed grooves (20) on the housing (102) to prevent the attached cover (1) from being moved upwardly.

2. A connector terminal protective cover as claimed in claim 1, wherein said arms (4, 4') are flexible and said projections (14, 14') extend along adjacent free ends of said arms (4, 4').

3. A connector terminal protective cover as claimed in claim 1, wherein said cover section (2) includes a projecting member (6) as an extension of said cover section (2)

disposed between said arms (4, 4'), said projecting member being flexible.

4. A connector terminal protective cover as claimed in claim 3, wherein said projecting member (6) has spaced recesses (10) along an inside surface thereof to receive the outermost terminals (106) therein.

5. A connector terminal protective cover as claimed in claim 1, wherein leading edges of said latching members (12, 12') said projections (14, 14') and said projecting member (6) are beveled.

* * * * *